US008903047B1

(12) United States Patent
Wang et al.

(10) Patent No.: US 8,903,047 B1
(45) Date of Patent: Dec. 2, 2014

(54) HIGH VOLTAGE CIRCUIT WITH ARC PROTECTION

(75) Inventors: Dongbing Wang, Lathrop, CA (US); Dave Reynolds, Orem, UT (US)

(73) Assignee: Moxtek, Inc., Orem, UT (US)

( * ) Notice: Subject to any disclaimer, the term of this patent is extended or adjusted under 35 U.S.C. 154(b) by 628 days.

(21) Appl. No.: 13/217,932

(22) Filed: Aug. 25, 2011

Related U.S. Application Data

(60) Provisional application No. 61/409,452, filed on Nov. 2, 2010.

(51) Int. Cl.
*H05G 1/10* (2006.01)

(52) U.S. Cl.
USPC ..... 378/101

(58) Field of Classification Search
USPC ..... 378/101, 102, 111, 112; 361/799, 800, 361/816
See application file for complete search history.

(56) References Cited

U.S. PATENT DOCUMENTS

| | | | | |
|---|---|---|---|---|
| 4,749,895 | A | 6/1988 | Ruelle | |
| 4,894,753 | A | 1/1990 | Wadell et al. | |
| 5,063,273 | A | 11/1991 | Bloks | |
| 5,120,242 | A | 6/1992 | Greiler et al. | |
| 5,330,559 | A | 7/1994 | Cheney et al. | |
| 5,376,759 | A | 12/1994 | Marx et al. | |
| 5,430,933 | A | 7/1995 | Marx et al. | |
| 5,475,606 | A | 12/1995 | Muyshondt et al. | |
| 6,600,809 | B1 * | 7/2003 | Ochiai | 378/101 |
| 6,866,544 | B1 | 3/2005 | Casey et al. | |
| 6,958,445 | B1 | 10/2005 | Boudreaux | |
| 7,256,995 | B2 | 8/2007 | Wrycraft et al. | |
| 7,491,901 | B2 | 2/2009 | Lu | |
| 2002/0097119 | A1 | 7/2002 | Molyneux et al. | |
| 2002/0118521 | A1 | 8/2002 | Kooker et al. | |
| 2004/0031972 | A1 | 2/2004 | Pflughaupt et al. | |
| 2008/0043925 | A1 * | 2/2008 | Sundaram | 378/203 |
| 2008/0107235 | A1 * | 5/2008 | Sundaram | 378/101 |
| 2013/0308757 | A1 * | 11/2013 | Wang | 378/101 |

* cited by examiner

*Primary Examiner* — Glen Kao
(74) *Attorney, Agent, or Firm* — Thorpe North & Western LLP

(57) ABSTRACT

A high voltage circuit with arc protection comprises a circuit board, having a top surface and a bottom surface, and includes at least two electronic components in a circuit. An enclosure substantially surrounds the circuit board. A voltage differential of at least 5000 volts can exist between the enclosure and at least one of the electronic components. At least one electrically conductive plate is disposed between the top surface of the circuit board and the enclosure, disposed between the bottom surface of the circuit board and the enclosure, electrically insulated from the circuit board and the enclosure, and provides arc protection between at least one electronic component on the circuit board and the enclosure.

19 Claims, 4 Drawing Sheets

HIGH VOLTAGE CIRCUIT WITH ARC PROTECTION

CLAIM OF PRIORITY

This claims priority to U.S. Provisional Patent Application Ser. No. 61/409,452, filed Nov. 2, 2010; which is hereby incorporated herein by reference in its entirety.

BACKGROUND

Unshielded, or insufficiently shielded, electronic components or electric circuits can be damaged due to arcing or short circuits. In very high voltage applications, it can be difficult to provide sufficient shielding to avoid such arcing or short circuits. For example, in a power supply for a small x-ray tube, a voltage differential of greater than 10 kV may exist between electronic components and a housing and the electronic components and housing may be separated by a distance of only about 1 cm. Potting may be used as an insulator, but such potting can break down, thus resulting in arcing or short circuits. Minor defects in the potting, including defects that cannot be visually observed, can allow such arcing or short circuits.

Shown in FIG. 7 is a prior art circuit board 11 with traces 62 and electronic components 13-14. Corners or sharp areas 73 on the components or connections to the components can have very high electric field strength if there is a large voltage difference between the corners or sharp areas 73 and a device 77. The electric field strength at such corners or sharp areas 73 can be substantially higher than the electric field strength at broader areas 74 of the components.

SUMMARY

It has been recognized that it would be advantageous to have a circuit design which provides improved shielding of electronic components and which reduces the electric field strength.

In one embodiment, the present invention is directed to a circuit board configured to operate as a corona guard that satisfies the need of improved shielding of electronic components and which reduces the electric field strength. The circuit board comprises at least one conductive trace disposed on a first insulating substrate and at least one conductive trace disposed on a second insulating substrate. The conductive trace disposed on the first insulating substrate can face the conductive trace disposed on the second insulating substrate. At least one electronic component can be electrically connected between the traces. The first and second insulating substrates substantially can surround the electronic component on at least two sides.

In another embodiment, the present invention is directed to a high voltage circuit with arc protection that satisfies the need of improved shielding of electronic components. The high voltage circuit with arc protection comprises a circuit board, having a top surface and a bottom surface, and including at least two electronic components in a circuit. An enclosure substantially surrounds the circuit board. A voltage differential of at least 5000 volts exists between the enclosure and at least one of the electronic components. At least one electrically conductive plate is disposed between the top surface of the circuit board and the enclosure, disposed between the bottom surface of the circuit board and the enclosure, electrically insulated from the circuit board and the enclosure, and provides arc protection between at least one electronic component on the circuit board and the enclosure.

DEFINITIONS

Figure 1:
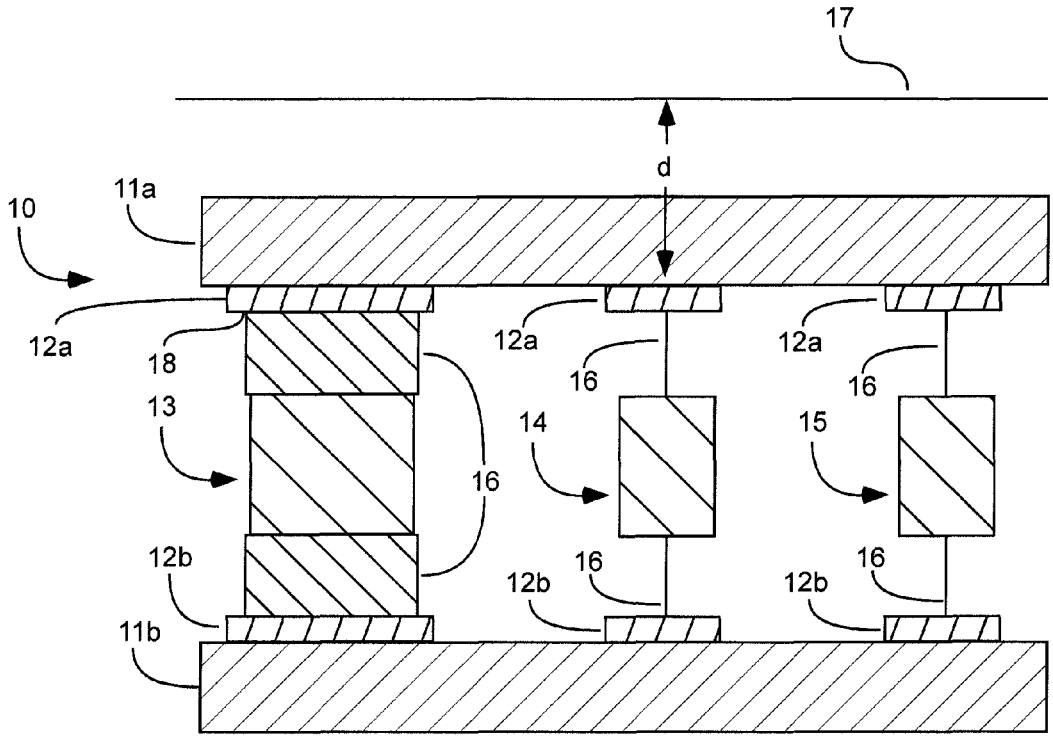
FIG. 1 is a schematic cross-sectional side view of a circuit board configured to operate as a corona guard in accordance with an embodiment of the present invention.

As used herein, the term "arc protection" means a device that protects against undesirable arcing between two devices at different voltages.

As used herein, the term "corona guard" can refer to a device that reduces a voltage gradient.

As used in this description and in the appended claims, the word "electronic component" does not include conductive wires, conductive traces, or connectors which merely connect one circuit to another. "Electronic component" does include, without limitation, devices which amplify, control, or switch voltages or currents without mechanical or other nonelectrical commands. "Electronic component" includes devices such as capacitors, resistors, diodes, transistors, integrated circuits, semiconductors, transistors, amplifiers, and inductors.

As used herein, the term "high voltage" or "higher voltage" refer to the DC absolute value of the voltage. For example, negative 1 kV and positive 1 kV would both be considered to be "high voltage" relative to positive or negative 1 V. As another example, negative 40 kV would be considered to be "higher voltage" than 0 V.

As used herein, the term "low voltage" or "lower voltage" refer to the DC absolute value of the voltage. For example, negative 1 V and positive 1 V would both be considered to be "low voltage" relative to positive or negative 1 kV. As another example, positive 1 V would be considered to be "lower voltage" than 40 kV.

As used herein, the terms "potting material" and "potting" mean insulating compounds, such as pourable insulating resins, that can be cast into cavities containing electronic components to insulate and protect the electronic components.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIG. 1, a circuit board configured to operate as a corona guard 10, includes at least one conductive trace 12*a* disposed on a first insulating substrate 11*a* and at least one conductive trace 12*b* disposed on a second insulating substrate 11*b*. The conductive trace(s) 12*a* disposed on the first insulating substrate 11*a* can face the conductive trace(s) 12*b* disposed on the second insulating substrate 11*b*. At least one electronic component 13-15 can be electrically connected between the two insulating substrates by electrical connection to the conductive traces. The first and second insulating substrates can substantially surround the electronic component(s) on at least two sides. In one embodiment, the conductive trace(s) 12 on each insulating substrate can comprise at least 3 electrically separate conductive traces. The first and second insulating substrates can be attached by insulating substrate material or there can be no insulating material connecting the two substrates. Insulating substrates 11 can be flexible or non-flexible material.

A traces 12 on the circuit can be separated from a device 17 and a substantial voltage differential may exist between at least one of the traces 12 and the device 17. For example, in an x-ray source power supply, the circuit could be used to generate a high voltage differential across an x-ray tube. The device 17 could be a casing or shell to house the x-ray source. A voltage differential between the device 17 and at least one of the traces 12 could be at least 30 kilovolts (kV).

Various types of electronic components 13-15 could be used, such as capacitors, resistors, diodes, transistors, integrated circuits, semiconductors, transistors, amplifiers, and inductors. For example, electronic component 13 could be a capacitor with metallic ends 16. Corners 18 on the ends 16 can be shielded from the device 17 by the trace 12*a*, thus reducing the electric field strength at the corners 18.

Figure 2:
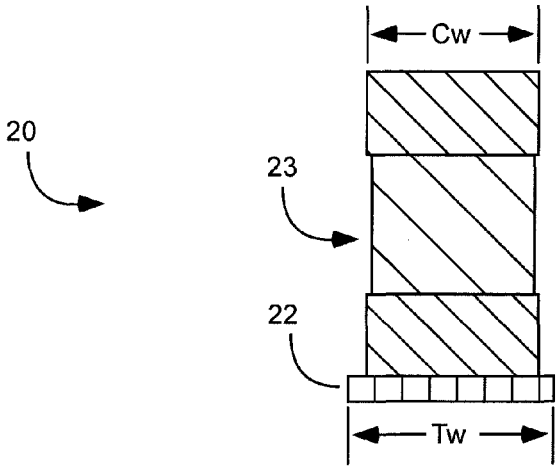
FIG. 2 is a schematic cross-sectional side view of an electronic component, showing component and trace widths, in accordance with an embodiment of the present invention.

As illustrated in FIG. 2, an example of an electronic component 23 is shown. In one embodiment, a width Cw of the electronic component 23 can be at least as wide as a width Tw of the trace 22. In another embodiment, a width Cw of the electronic component 23 can be at least 1.2 times wider than a width Tw of the trace 22. In another embodiment, a width Cw of the electronic component 23 can be at least 1.5 times wider than a width Tw of the trace 22. Wider traces can help shield the component and reduce the electric field strength thus helping to avoid arcing or short circuiting. Note that in a single plane of the trace, such plane parallel with a surface of the insulating substrate to which the trace is attached, there exists a "width" and a "length" of the trace. The length would be the longer of the two dimensions "width" and "length". Width of a trace is a dimension perpendicular to the length. The electronic component 23 can be representative of any electronic component in any of the invention embodiments described herein. The trace 22 can be representative of any trace in any of the invention embodiments described herein.

Figure 3:
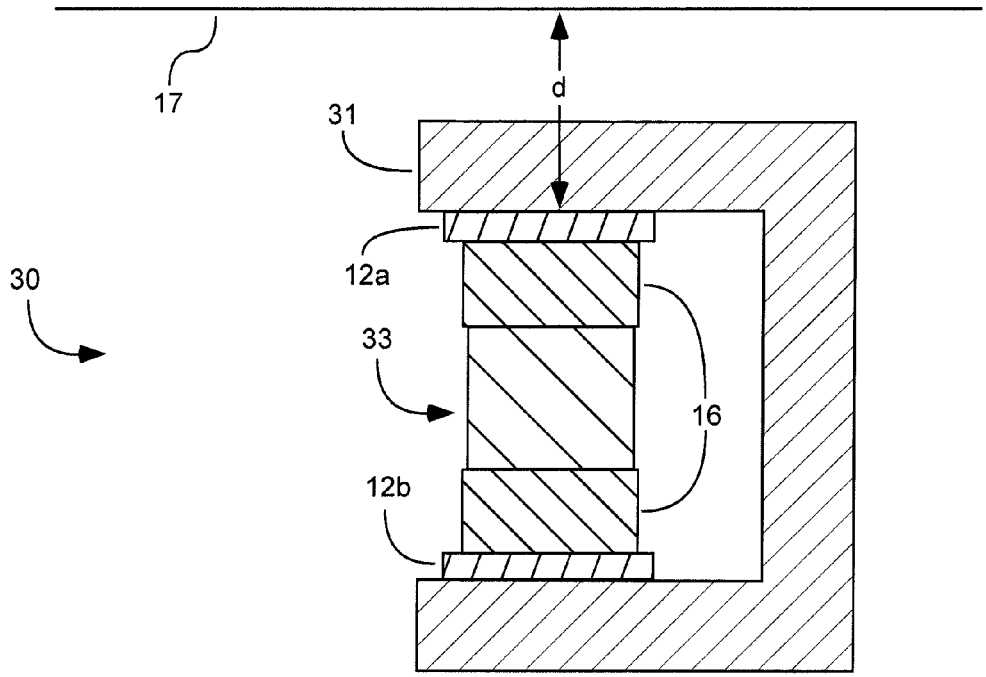
FIG. 3 is a schematic cross-sectional side view of a circuit board configured to operate as a corona guard, with the circuit board substantially surrounding at least one electronic component on at least three sides, in accordance with an embodiment of the present invention.

In a circuit board configured to operate as a corona guard 30 shown in FIG. 3, an insulating substrate 31 can substantially surround at least one electronic component 33 on at least three sides. Traces 12 and electronic component(s) 33 can be disposed on the substrate 31 in a similar manner as was described previously for the circuit board 10 shown in FIG. 1. The insulating substrate 31 can comprise a flexible material. The conductive traces 12 on the insulating substrate 31 can act as a corona guard for the electronic component(s) 33.

Figure 5:
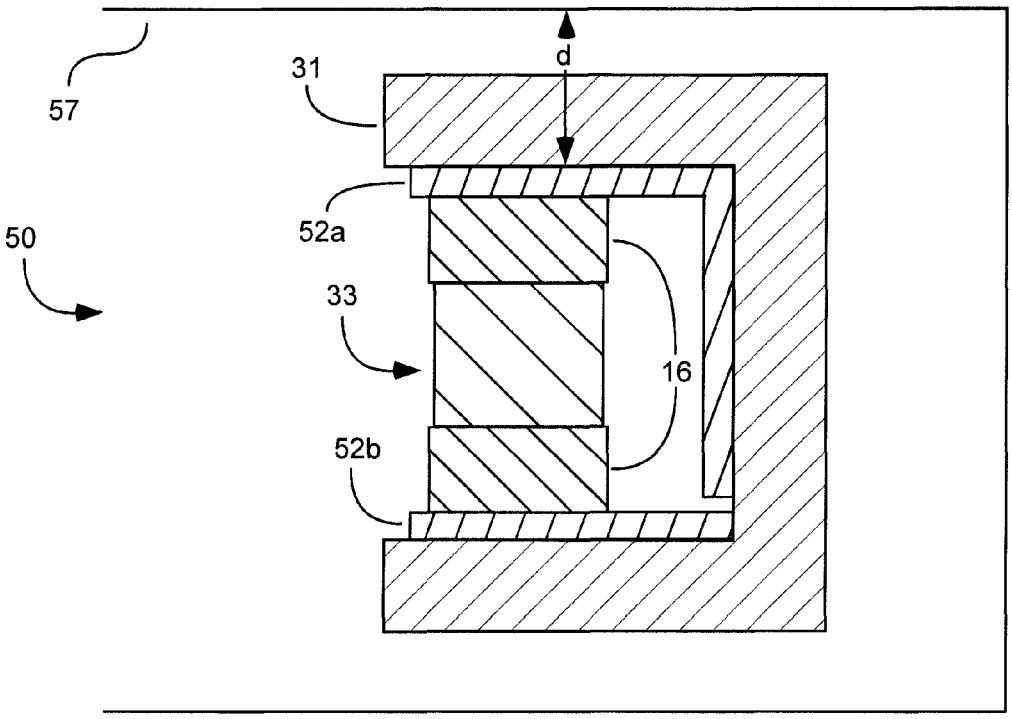
FIG. 5 is a schematic cross-sectional side view of a circuit board configured to operate as a corona guard, with the circuit board substantially surrounding at least one electronic component on at least three sides, in accordance with an embodiment of the present invention.

In a circuit board configured to operate as a corona guard 50 shown in FIG. 5, an insulating substrate 31 and traces 52 can substantially surround at least one electronic component 33 on at least three sides. For example, at least one trace 52*a* can attach to the electronic component(s) 33 on one end of the component(s) 33 and can substantially surround the component 33 on at least two sides. At least one trace 52*b* can attach to the electronic component(s) 33 on an opposite end of the component(s) 33 and can substantially surround the electronic component(s) 33 on at least one side. Traces 52 and electronic component(s) 33 can be disposed on the substrate 31 in a similar manner as was described previously for the traces 12 and electronic component(s) 13-15 of the circuit board 10 shown in FIG. 1. The insulating substrate 31 can comprise a flexible material. The conductive traces 52 on the insulating substrate 31 can act as a corona guard for the at least one electronic component 13.

Figure 4:
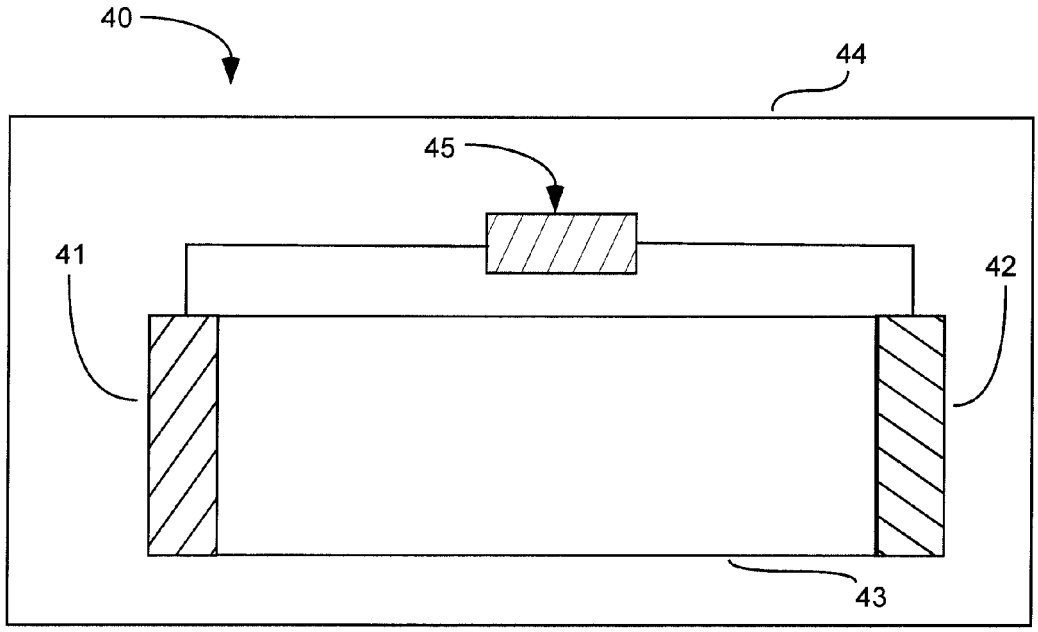
FIG. 4 is a schematic cross-sectional side view of an x-ray source with a circuit board configured to operate as a corona guard in accordance with an embodiment of the present invention.

As shown in FIG. 4, The various circuit board embodiments described herein 45 may be used in an x-ray source 40. The x-ray source 40 can comprise an x-ray tube 43 including an anode 41 and a cathode 42 at opposing ends of the tube 43 and a voltage differential between the anode 41 and the cathode 42. The voltage differential can be supplied by the circuit board 45. In one embodiment, the voltage differential can be at least about 5 kilovolts. In another embodiment, the voltage differential can be at least about 30 kilovolts. The circuit board 45 and the x-ray tube 43 can be enclosed in a container 44. The container 44 can be maintained at approximately zero volts. In one embodiment, a voltage differential between at least one component in the circuit 45 and the container can be at least about 5 kilovolts. In another embodiment, a voltage differential between at least one component in the circuit 45 and the container can be at least about 30 kilovolts.

Use of the various circuit board embodiments described herein can reduce electric field strength at or near the electronic components 13-15 or 33 or at or near traces 12 or 52. For example, a device 17 can be disposed on an opposing side of the insulating substrate 11 or 31 from the conductive trace 12 or 52. Between the device 17 and the trace 12 or 52, there may be (1) a voltage differential of at least 1 kilovolt, at least 25 kilovolts, or at least 45 kilovolts, (2) a distance d of less than about 3 centimeters, and (3) a maximum electric field strength of less than about 240 kilovolts per centimeter.

Also, in this same embodiment there can be between the device 17 and at least one of the electronic components 13-15 or 33 (1) a voltage differential of at least 1 kilovolt, at least 25 kilovolts, or at least 45 kilovolts, (2) a distance d of less than about 3 centimeters, and (3) a maximum electric field strength of less than about 240 kilovolts per centimeter. In another embodiment, between the device 17 and the trace 12 or 52 and/or, at least one of the electronic components 13-15 or 33 there may be (1) a voltage differential of at least 25 kilovolts or at least 45 kilovolts, (2) a distance d of less than about 2 centimeters, and (3) a maximum electric field strength of less than about 200 kilovolts per centimeter.

Figure 6:
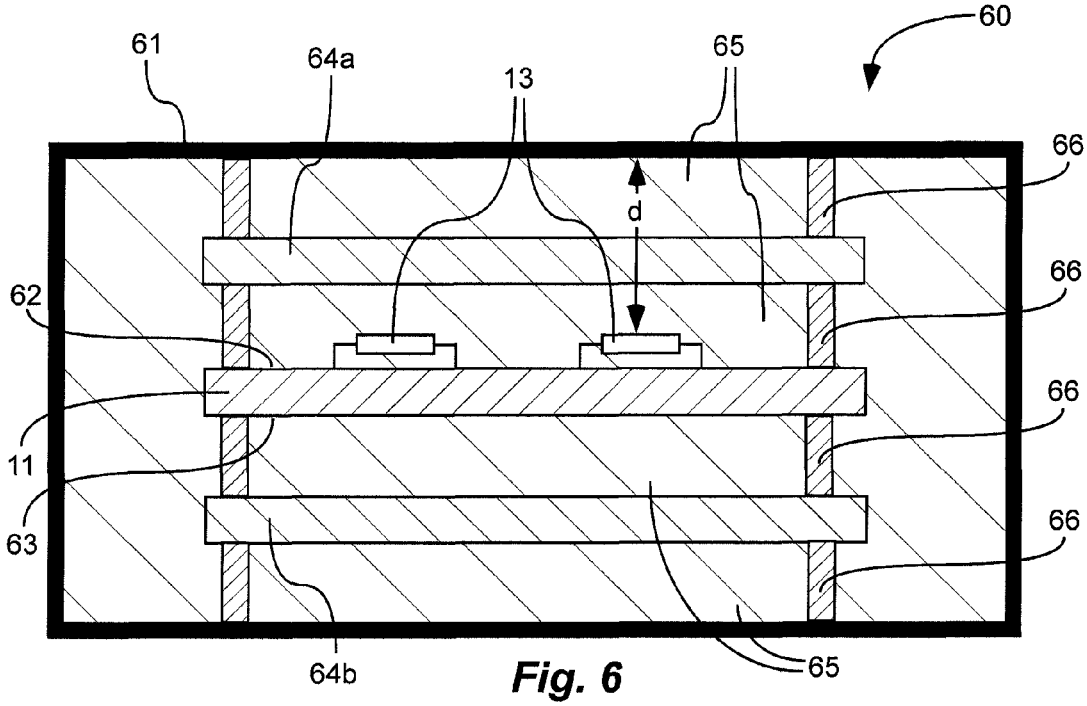
FIG. 6 is a schematic cross-sectional side view of a high voltage circuit with arc protection, in accordance with an embodiment of the present invention.
Figure 7:
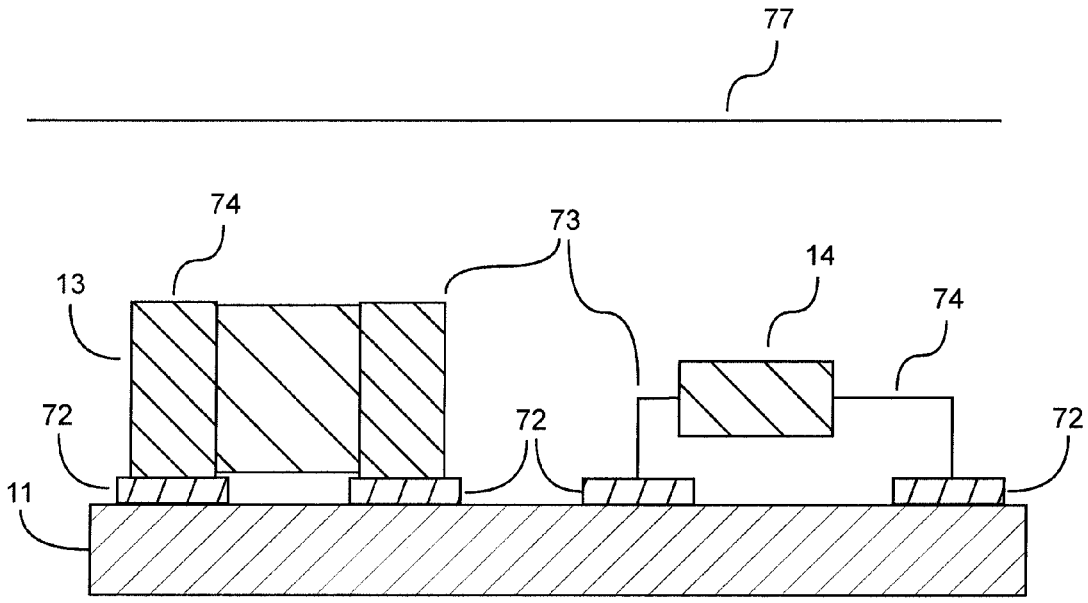
Fig. 7 Prior Art
FIG. 7 is a schematic cross-sectional side view of a prior art circuit board.

Another embodiment of the present invention is a high voltage circuit with arc protection 60 shown in FIG. 6. The high voltage circuit with arc protection 60 comprises a circuit board 11, having a top surface 62 and a bottom surface 63, and including at least two electronic components 13 in a circuit. The top surface 62 and the bottom surface 63 can be substantially parallel with each other. The electronic components 11 can be disposed on the top surface 62 or the bottom surface 63. An enclosure 61 can substantially surround the circuit board 11. The enclosure can be a case for holding power supply components. The power supply can be used to provide a high voltage bias of at least 10,000 volts between an anode and a cathode of an x-ray tube. The circuit board 11 and the enclosure 61 can be configured to have a voltage differential of at least 5000 volts between the enclosure 61 and at least one of the electronic components 13. For example, the enclosure 61 can be at ground potential and the electronic components 13 can be part of a high voltage generation circuit or can be components disposed between the high voltage generation circuit and a high voltage device. In another embodiment, the circuit board 11 and the enclosure 61 can be configured to have a voltage differential of at least 15,000 volts between the enclosure 61 and at least one of the electronic components 13. In another embodiment, the circuit board 11 and the enclosure 61 can be configured to have a voltage differential of at least 25,000 volts between the enclosure 61 and at least one of the electronic components 13.

At least one electrically conductive plate 64 can be disposed between the top surface 62 of the circuit board 11 and the enclosure 61, disposed between the bottom surface 63 of the circuit board 11 and the enclosure 61, electrically insulated from the circuit board 11 and the enclosure 61, and can provide arc protection between at least one electronic component 13 on the circuit board 11 and the enclosure 61. Arc protection can be provided by the plate reducing electrical field gradients between the electronic component 13 and the enclosure 61, thus reducing the chance of electronic component 13 failure due to arcing between the electronic component 13 and the enclosure 61.

The high voltage circuit with arc protection 60 can be especially useful for separating very large voltages in small volumes. In one embodiment, the enclosure can have an internal volume of less than 200 $cm^3$. In another embodiment, the enclosure can have an internal volume of less than 1000 $cm^3$. In another embodiment, the enclosure can have an internal volume of less than 10,000 $cm^3$. In one embodiment, a distance d between a component 13 on the circuit board 11 and the enclosure can be less than 1 cm and a voltage differential between this component and the enclosure can be at least 5000 volts. In another embodiment, a distance d between a component 13 on the circuit board 11 and the enclosure can be less than 2 cm and a voltage differential between this component and the enclosure can be at least 5000 volts. In another embodiment, a distance d between a component 13 on the circuit board 11 and the enclosure can be less than 4 cm and a voltage differential between this component and the enclosure can be at least 5000 volts.

In one embodiment, the at least one electrically conductive plate 64 can be a single plate wrapped around, and electrically insulated from, the circuit board 11. In another embodiment, the at least one electrically conductive plate 64 can be at least two electrically conductive plates 64*a*-*b*. One of the electrically conductive plates 64*a* can be disposed between the top surface 62 of the circuit board 11 and the enclosure 61 and the other electrically conductive plate 64*b* can be disposed between the bottom surface 63 of the circuit board 11 and the enclosure 61.

In one embodiment, the high voltage circuit 60 can be made with electrically conductive plates 64 comprised of metal sheets disposed on a rigid insulative substrate. The substrate can be standard circuit board substrate material. The electrically conductive plates 64 can be attached to the circuit board by insulative connectors 66. This embodiment may be selected for ease of manufacturing. Electrically insulative potting material 65 can be disposed between the circuit board 11 and the electrically conductive plates 64 and between the electrically conductive plates 64 and the enclosure 61.

In one embodiment, a surface area of one side of the at least one electrically conductive plate 64 can be between one-half to one times the surface area of the top surface 62 and bottom surface 63 of the circuit board 11. In another embodiment, a surface area of one side of the at least one electrically conductive plate 64 can be approximately the same as the surface area of the top surface 62 and bottom surface 63 of the circuit board 11. In another embodiment, a surface area of one side of the at least one electrically conductive plate 64 can be between the one to two times the surface area of the top surface 62 and bottom surface 63 of the circuit board 11.

How to Make

For the circuit board 10 of FIG. 1, components 13-15 can be soldered to traces 12*b*. Opposing ends of the components can then have solder paste applied. Traces 12*a* can be aligned with the components 13-15 and set in place on the components. The solder paste can then seal the components to traces 12*a*, such as by high temperature in an oven.

For the circuit board 30 of FIG. 3, component(s) 33 can be soldered to trace(s) 12*b*. Opposing ends of the component(s) can then have solder paste applied. The insulating substrate 31 can then be wrapped around the component(s) 33 and trace(s) 12*a* can be aligned with the component(s) 33 and set in place on the component(s). The solder paste can then seal the component(s) 33 to trace(s) 12*a*, such as by high temperature in an oven.

For the circuit board 50 of FIG. 5, component(s) 33 can be soldered to trace(s) 52*b* (or 52*a*). Opposing end(s) of the component(s) can then have solder paste applied. The insulating substrate 31 can then be wrapped around the component(s) 33 and trace(s) 52*a* (or 52*b*) can be aligned with the component(s) 33 and set in place on the component(s). The solder paste can then seal the component(s) to trace(s) 52*a* (or 52*b*), such as by high temperature in an oven. Trace(s) 52*a* can be flexible so as to allow bending with the insulating substrate 31.

The embodiments of the present invention may also be made by aligning components with traces then adhering components to traces by wave solder.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A high voltage circuit with arc protection comprising:
a. a circuit board, having a top surface and a bottom surface, and including at least two electronic components in a circuit;
b. an enclosure that substantially surrounds the circuit board;
c. the circuit board and the enclosure configured to have a voltage differential of at least 5000 volts between the enclosure and at least one of the electronic components; and
d. at least one electrically conductive plate:
i) disposed between the top surface of the circuit board and the enclosure;
ii) disposed between the bottom surface of the circuit board and the enclosure;
iii) electrically insulated from the circuit board and the enclosure; and
iv) providing arc protection between at least one electronic component on the circuit board and the enclosure.

2. The high voltage circuit of claim 1, wherein the at least one electrically conductive plate comprises at least two electrically conductive plates and wherein one of the electrically conductive plates is disposed between the top surface of the circuit board and the enclosure and the other electrically conductive plate is disposed between the bottom surface of the circuit board and the enclosure.

3. The high voltage circuit of claim 2, wherein:
a. the electrically conductive plates comprise metal sheets disposed on a rigid insulative substrate;
b. the electrically conductive plates are attached to the circuit board by insulative connectors; and
c. electrically insulative potting material is disposed between the circuit board and the electrically conductive plates and between the electrically conductive plates and the enclosure.

4. The high voltage circuit of claim 1, wherein the enclosure has an internal volume of less than 10,000 $cm^3$.

5. The high voltage circuit of claim 1, wherein the enclosure has an internal volume of less than 1000 $cm^3$.

6. The high voltage circuit of claim 1, wherein the enclosure has an internal volume of less than 200 $cm^3$.

7. The high voltage circuit of claim 1, wherein a distance between a component on the circuit board and the enclosure is less than 4 cm.

8. The high voltage circuit of claim 1, wherein a distance between a component on the circuit board and the enclosure is less than 2 cm.

9. The high voltage circuit of claim 1, wherein a distance between a component on the circuit board and the enclosure is less than 1 cm.

10. The high voltage circuit of claim 1, wherein a surface area of one side of the at least one electrically conductive plate is substantially the same as the surface area of the top surface and the bottom surface of the circuit board.

11. The high voltage circuit of claim 1, wherein a surface area of one side of the at least one electrically conductive plate is between one half to one times a surface area of the top surface and the bottom surface of the circuit board.

12. The high voltage circuit of claim 1, wherein a surface area of one side of the at least one electrically conductive plate is between the one to two times a surface area of the top surface and the bottom surface of the circuit board.

13. The high voltage circuit of claim 1, wherein the at least one electrically conductive plate comprises a single plate wrapped around the circuit board.

14. A high voltage circuit with arc protection comprising:
a. a circuit board, having a top surface and a bottom surface, and including at least two electronic components in a circuit;
b. an enclosure that substantially surrounds the circuit board;
c. the circuit board and the enclosure configured to have a voltage differential of at least 5000 volts between the enclosure and at least one of the electronic components; and
d. at least two electrically conductive plates including one of the electrically conductive plates disposed between the top surface of the circuit board and the enclosure, and the other electrically conductive plate disposed between the bottom surface of the circuit board and the enclosure, the at least two electrically conductive plates:
i) electrically insulated from the circuit board and the enclosure; and
ii) providing arc protection between at least one electronic component on the circuit board and the enclosure;
e. the electrically conductive plates comprising metal sheets disposed on a rigid insulative substrate;
f. the electrically conductive plates being attached to the circuit board by insulative connectors; and
g. electrically insulative potting material disposed between the circuit board and the electrically conductive plates and between the electrically conductive plates and the enclosure.

15. The high voltage circuit of claim 14, wherein a surface area of one side of the at least one electrically conductive plate is substantially the same as the surface area of the top surface and the bottom surface of the circuit board.

16. The high voltage circuit of claim 14, wherein a surface area of one side of the at least one electrically conductive plate is between one half to one times a surface area of the top surface and the bottom surface of the circuit board.

17. The high voltage circuit of claim 14, wherein a surface area of one side of the at least one electrically conductive plate is between one to two times a surface area of the top surface and the bottom surface of the circuit board.

18. A high voltage circuit with arc protection comprising:
a. a circuit board, having a top surface and a bottom surface, and including at least two electronic components in a circuit;
b. an enclosure that substantially surrounds the circuit board;
c. the circuit board and the enclosure configured to have a voltage differential of at least 5000 volts between the enclosure and at least one of the electronic components; and
d. at least two electrically conductive plates including one of the electrically conductive plates disposed between the top surface of the circuit board and the enclosure, and the other electrically conductive plate disposed between the bottom surface of the circuit board and the enclosure, the at least two electrically conductive plates:
i) electrically insulated from the circuit board and the enclosure; and
ii) providing arc protection between at least one electronic component on the circuit board and the enclosure;
e. the electrically conductive plates comprising metal sheets disposed on a rigid insulative substrate;

f. the electrically conductive plates being attached to the circuit board by insulative connectors;

g. electrically insulative potting material disposed between the circuit board and the electrically conductive plates and between the electrically conductive plates and the enclosure;

h. the enclosure having an internal volume of less than 200 $cm^3$; and i. a distance between a component on the circuit board and the enclosure being less than 1 cm.

19. The high voltage circuit of claim 18, wherein a surface area of one side of the at least one electrically conductive plate is substantially the same as the surface area of the top surface and the bottom surface of the circuit board.

* * * * *